United States Patent [19]

Obland

[11] 4,437,579

[45] Mar. 20, 1984

[54] DRUG DISPENSING APPARATUS AND REMOVAL TOOL

[76] Inventor: Donald R. Obland, 6750 S. Clermont St., Littleton, Colo. 80122

[21] Appl. No.: 342,196

[22] Filed: Jan. 25, 1982

[51] Int. Cl.[3] ..... B65D 83/04

[52] U.S. Cl. ..... 221/25; 221/74; 29/278

[58] Field of Search ..... 221/25, 30, 71, 72, 221/74; 206/403–406, 408, 390, 531, 533, 538, 539, 528; 29/258–260, 270, 271, 278, 280

[56] References Cited

U.S. PATENT DOCUMENTS

| | | | |
|---|---|---|---|
| 1,109,942 | 9/1914 | Robbins | 29/258 X |
| 3,125,214 | 3/1964 | Merila | 206/538 X |
| 3,241,223 | 3/1966 | Anderson | 29/259 |
| 3,362,578 | 1/1968 | Spencer | 221/25 |
| 3,450,306 | 6/1969 | Gill | 221/71 |
| 3,561,591 | 2/1971 | Henderson | 206/42 |
| 3,563,368 | 2/1971 | McHugh | 206/42 |
| 3,995,363 | 12/1976 | Medina | 29/280 |

*Primary Examiner*—F. J. Bartuska
*Attorney, Agent, or Firm*—Ancel W. Lewis, Jr.

[57] ABSTRACT

A child-proof dispenser includes a container (11) having an inner shell (15) covered by an outer shell section (18) to form an inner compartment (12) enclosing a coiled strip of blister-packaged drugs (13) or the like. The inner and outer shells are releasably interlocked together by central hub portions (31, 25) which support the outer shell for rotation relative to the inner shell. The outer shell is rotated away from a stop (46, 47) and against the action of a compression spring (48) to aline inner and outer dispensing openings (42, 45) in the inner and outer shells, respectively. An ejecting trigger (55) carried by the outer shell is moved relative to both shells against the strip in a guide passage (46) to advance a selected number of doses of drugs via the dispensing openings. Upon release of the shells, the compression spring moves the outer shell to a position to cover the inner dispensing opening. A removal tool (81) releasably mounted on a top knob 71 on the outer shell and has a plunger (87) that extends into the outer shell and against the central hub portion of the inner shell to release the central hub portions to separate the shells for the insertion of a new strip of blister-packeged drugs into the inner compartment.

14 Claims, 10 Drawing Figures

DRUG DISPENSING APPARATUS AND REMOVAL TOOL

TECHNICAL FIELD

This invention relates to a novel and improved dispensing apparatus and tool that is particularly suited for use in dispensing blister-packaged drugs.

BACKGROUND ART

Containers of a variety of types have heretofore been provided for containing and dispensing pharmaceutical products including pills, tablets, capsules, powders and the like. Plastic tubing has been used to form a strip of packaged pills and this form of packaging pills has the advantage of keeping the pills clean, protecting them from moisture, and allowing a plurality of the pills to be easily handled. These are also referred to as blister-packaged drugs. Some attempts have been made to provide child-proof containers for dispensing these blister-packaged drugs. U.S. Pat. No. 3,450,306 describes a pill dispenser including a container with a disc-like cover and a ratchet structure locks the cover to prevent operation by children. The present invention is believed to provide a number of advantages and improvements in this prior art.

DISCLOSURE OF INVENTION

A dispenser for a coiled strip of blister-packaged drugs has a container with an inner compartment for enclosing the strip of drugs. The container is made of separate, interfitting, inner and outer cup-like shells held together by coaxially arranged, releasably interlocked, hub portions. Each shell has a dispensing opening through which the end of the strip is passed when the shells are hand held so that the dispensing openings are in alinement. A biasing member normally rotates the outer shell so that the inner dispensing opening is covered by the outer shell and a turning of the outer shell is required to aline the inner and outer dispensing openings. An ejecting trigger extends into the container and engages the strip and is moved relative to the shells to advance the strip through the dispensing openings. A removal tool releasably mounts on a knob formed on the outer shell and the tool has a plunger that inserts into a hole in the outer shell to bear against a central hub portion of the inner shell to release the outer shell from the inner shell to add coiled strips of drugs when required.

BRIEF DESCRIPTION OF DRAWINGS

The details of this invention will be described in connection with the accompanying drawings, in which.

DETAILED DESCRIPTION

Figure 1:
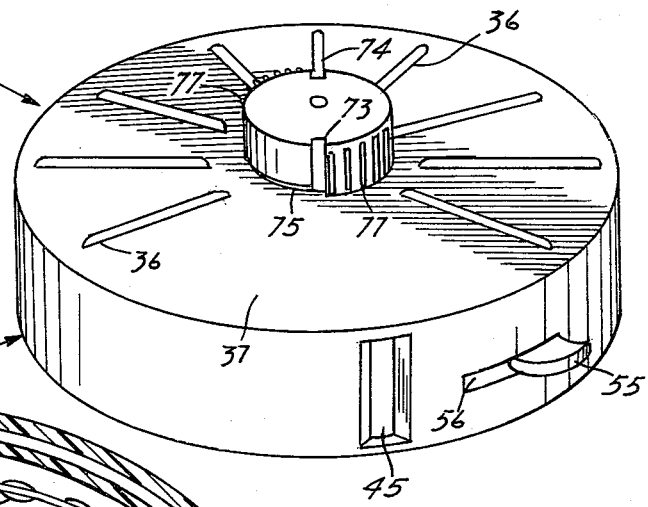
FIG. 1 is a top perspective view of a dispenser embodying features of the invention.

Referring now to the drawings, the dispenser shown includes a cylindrical container 11 forming an inner compartment 12 sized and shaped as a cylinder for enclosing a coiled strip of blister-packaged drugs 13. The container 11 is made up of an inner shell 15 of cylindrical shape having a bottom wall portion 16 and an inner sidewall portion 17 integral with and extending up from the inner sidewall portion, together with an outer shell 18 separable from and fitted over the inner shell in an outer, spaced, concentric relationship. The outer shell is of a cup-like cylindrical shape and includes a top wall portion 19 extending over the top of the inner shell and an outer sidewall portion projecting down from and integral with the top wall portion 19 and overlapping the inner side wall portion 17.

The inner shell 15 has a central hub portion 25 projecting down from the center of the top wall portion 19 with a vertical center hole 26 and an annular inwardly extending inner ridge 27 midway down the hole 25 to form a female socket portion of a releasable locking joint for the shells. The outer shell 18 has a central hub portion 31 projecting up from the center of the bottom wall portion 16 with an annular recess 32 in an enlargement of hole 26 to form a male socket portion of a releasable locking joint for the shells 15 and 18.

When the hub portion 31 is inserted in hole 26 the recess 32 receives the ridge 27 and the two shells are releasably locked together by the interfitting hub portions 25 and 31, while at the same time permitting the outer shell 18 to be rotated around the inner shell 15 about a common central axis for the two shells. This locking joint, plus the fact that the inner shell is covered by the outer shell except along the bottom wall portion 16, makes separation of the two walls difficult for children except by the use of the special tool described hereinafter. The interlocking hub portions 25 and 31 also form a central support for the coiled strip of pills 13.

The shells 15 and 18 are preferably formed of a hard-surfaced molded plastic and each is of a one-piece construction. The bottom wall portion 16 is shown to have a plurality of spaced radially extending ribs 35 for gripping by the user. Similarly, the top wall portion 19 has a plurality of radially extending spaced ribs 36 for gripping by the user, the top surface area being left flat and smooth as indicated at 37 for the placement of a prescription label thereon or other indicia means. A coil spring 38 is shown between the outer hub portion 25 and the coiled strip of blister-packaged drugs 13 to advance the strip from the dispenser as the strip diminishes in length.

An inner dispensing opening 41 is formed in the inner sidewall portion 17 through which the outer end of the strip 13 will pass when exposed via the outer shell. A cut-off blade 42 forms one side of inner dispensing opening 41. An inside arcuate guide section 43 extends inwardly from the inside wall of the inner sidewall portion 17 beginning at the other side of the inner dispensing opening 41 opposite blade 42 and in a spaced relation to the inner surface of sidewall portion 17 and along a radius smaller than the radius of the sidewall portion 17. Guide section 43 extends through an arc of less than 45 degrees to define with the inner sidewall portion an elongated guide passage 44 for guiding the movement of a segment of the strip 13 prior to its passing through the inner dispensing opening 41. An outer dispensing opening 45 is formed in the outer sidewall portion 21.

Figure 7:
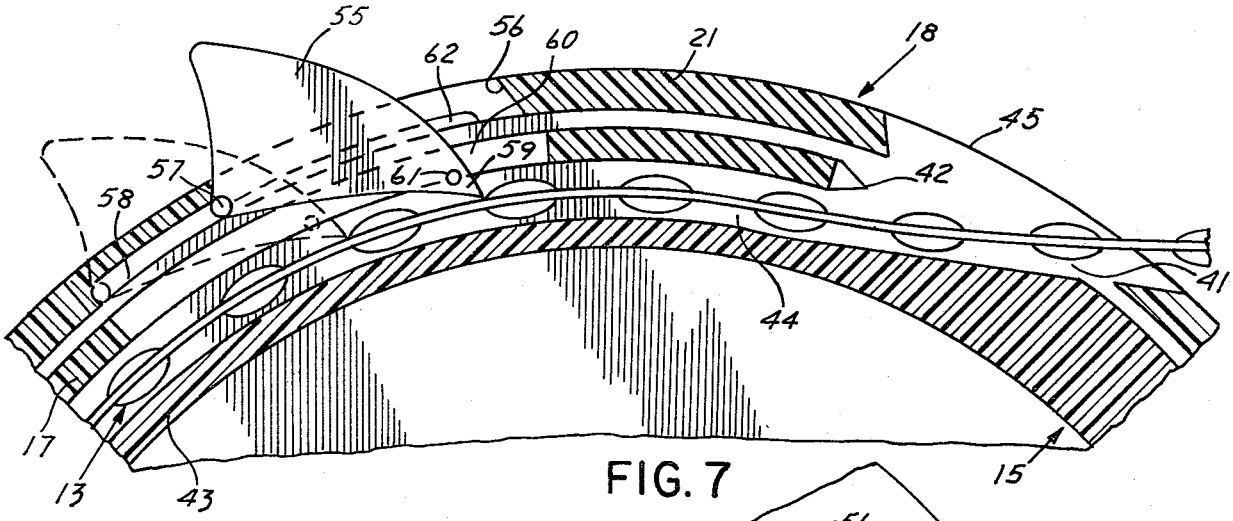
FIG. 7 is an enlarged vertical sectional view taken along the same lines as in FIG. 3 with the outer shell in the dispensing position, the initial position for the trigger shown in dashed lines, and showing the trigger advanced against the strip to move a drug dosage through the dispensing openings.
Figure 4:
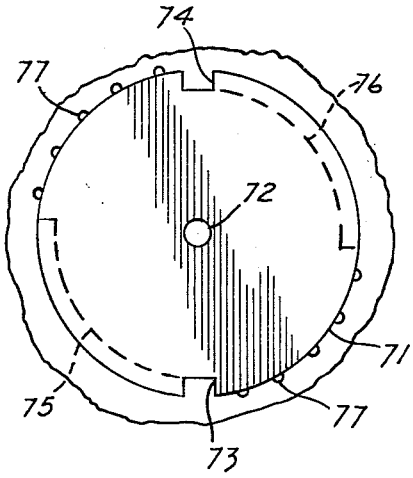
FIG. 4 is an enlarged top plan view showing the top knob of the dispenser shown in FIG. 1.
Figure 8:
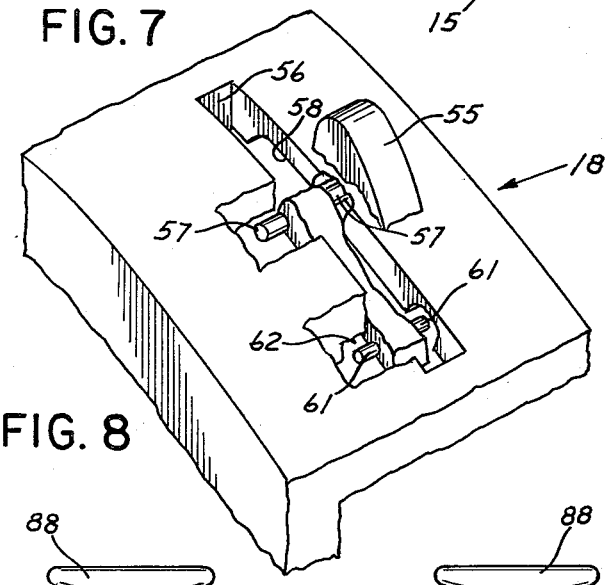
FIG. 8 is a fragmentary perspective view of the trigger and outer shell with portions broken away to show interior construction.
Figure 5:
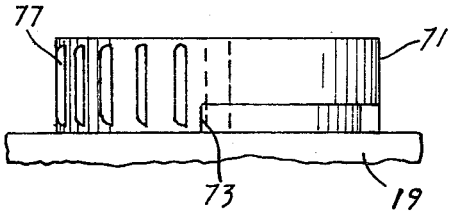
FIG. 5 is a side elevation view of the top knob.
Figure 6:
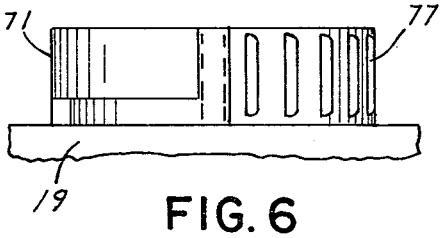
FIG. 6 is another side elevation view of the top knob at ninety degrees to FIG. 5.

The outer shell is rotated in a clockwise direction from the inner shell, as viewed from the top, to aline the outer dispensing opening 45 with the inner dispensing opening 41 as shown in FIG. 7. The edges bordering the opening 45 are beveled for a free exit for the strip from the dispenser.

Figure 3:
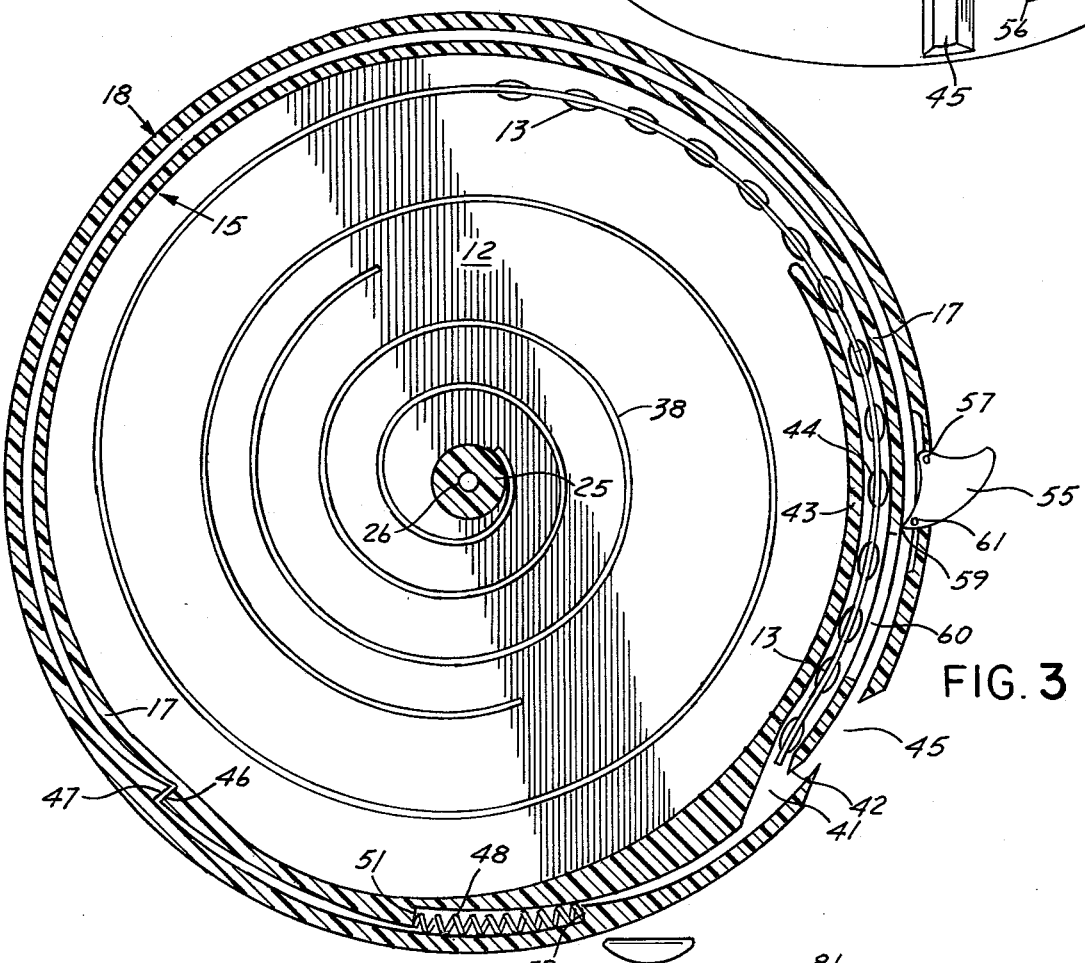
FIG. 3 is a sectional view taken along lines 3—3 of FIG. 2.

The exterior surface of the inner sidewall portion is formed with a recess that terminates in a radial edge 46. A recess that terminates in a radial edge 47 provides a protruding part on the inside of the outer sidewall portion to form a stop or limit to prevent the outer shell from rotating beyond a certain point in a counterclockwise direction as viewed from the top to hold the shells in the at-rest position as seen in FIG. 3.

A return member 48 in the form of a compression spring is mounted between a radial edge 51 adjacent a recess formed in the inner sidewall portion 17 and a radial edge 52 adjacent a recess formed in the outer sidewall portion 21 to return the outer shell to an at-rest position after a dispensing operation. In the at-rest position shown in FIG. 3 the outer sidewall portion 21 covers the inner dispensing opening 21 to prevent an undesirable dispensing of the drugs, as by children.

For advancing the strip 13 in and through the container 11, there is provided an ejecting trigger 55 mounted to slide in a slot 56 in the outer sidewall portion 21. The trigger 55 has a pair of oppositely disposed laterally extending rear pins 57 that are carried in inside slots 58 extending laterally in from the slot 56 along the inner surface of the outer sidewall portion 21 and guide the movement of the trigger during a dispensing operation. The trigger 55 has a downturned front end portion 59 which, in the at-rest position shown in FIG. 3, rests on the outer surface of the inner sidewall portion.

Once the outer shell is rotated clockwise with respect to the inner shell as viewed from the top and the dispensing openings 41 and 45 are in substantial alinement, the downturned front end portion 59 passes through a slot 60 in the inner sidewall portion. This is shown in dashed lines in FIG. 7. The trigger is advanced in a clockwise direction as viewed from the top in a forward stroke as seen in FIG. 7. While the rear pins 57 move in the slots 58 the trigger pivots slightly about the rear pins to advance a dose through the dispensing openings.

A second set of laterally extending front pins 61 projects out from the side faces of the trigger and each extends into a smaller slot 62 extending laterally in from the slot 56 in the outer sidewall portion 21 to prevent the front end of the trigger from flipping out of the slot 56 after a dispensing operation.

To dispense the drugs, the inner shell 15 is held stationary by one hand and the outer shell 18 is rotated clockwise, as viewed from the top, with the other hand until the inner and outer dispensing openings 41 and 45 are alined as seen in FIG. 7. The forward downturned end portion 59 of the trigger is dropped down through the opening 60 and is in the position shown in dashed lines. The two shells are held in this position by one hand while the other hand operates the ejecting trigger 55 in a forward stroke as shown in full lines in FIG. 7 to eject selected one or more dosages.

The strip 13 is then pulled against the cutting edge of the cut-off blade 42 to secure the desired number of dosages. The other hand is then relaxed and the spring 48, which has been under compression during dispensing, expands and moves the shells to the at-rest position with surfaces 46 and 48 abutting one another and the inner dispenser being covered by the outer sidewall portion 21 to prevent further access to the strip of drugs.

For separating the inner and outer shells there is provided a top knob 71 integrally connected at a top central position on the top wall portion 19. This top knob 71 has a central hole 72 that alines with the hole 26 in the central hub portion 25. Knob 71 further has a pair of opposing vertical grooves 73 and 74 that extend down opposite side edges and each communicates with undercut grooves 75 and 76, respectively, extending along the bottom of the knob and above the top surface of top wall portion 19. Each of the grooves 75 and 76 extends through an arc of 90 degrees and the grooves are diametrically opposed to one another. Grip ribs 77 are provided on the periphery of opposite portions of the knob which do not have the undercut grooves 75 and 76 for gripping by the user to rotate the outer shell relative to the inner shell.

Figure 2:
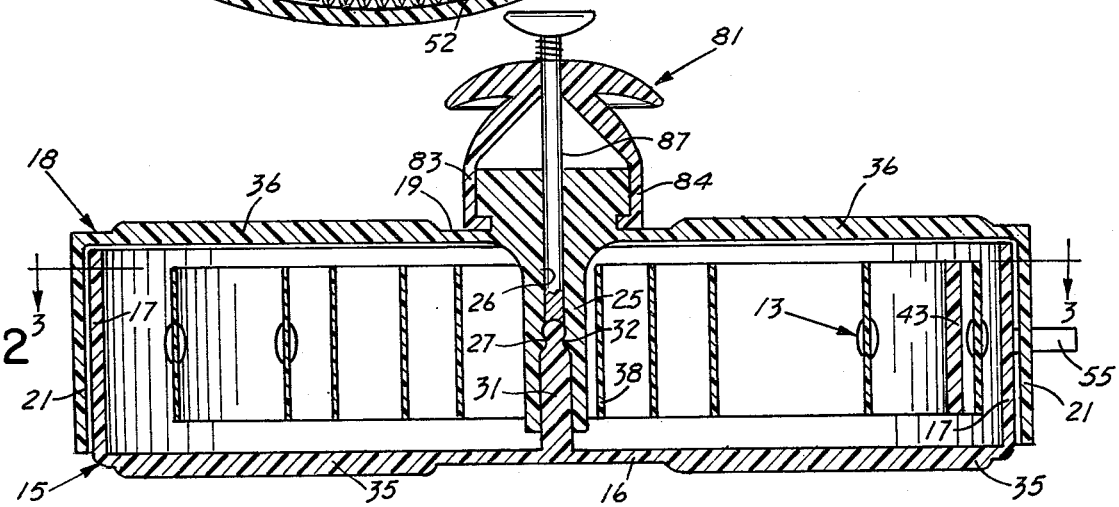
FIG. 2 is a vertical sectional view of the dispenser shown in FIG. 1 with the shells in the at-rest position.
Figure 9:
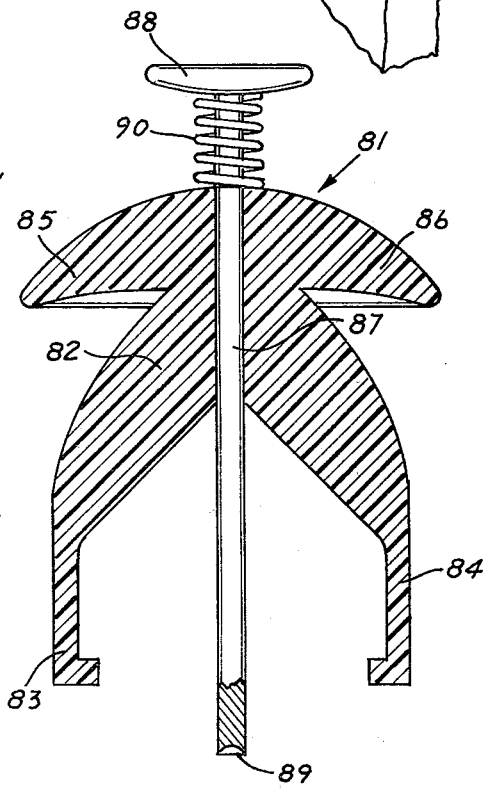
FIG. 9 is a side elevation view of a removal tool for separating the inner and outer shells.
Figure 10:
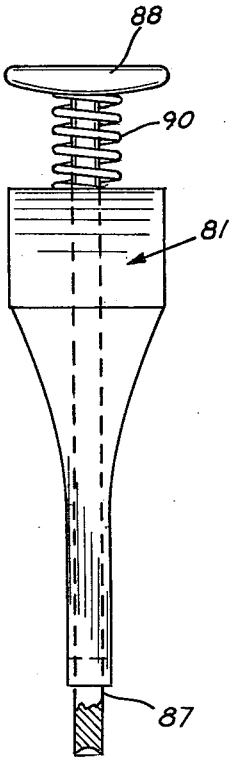
FIG. 10 is an elevation view of the removal tool shown in FIG. 9.

The removal tool 81 for separating the shells, shown in FIGS. 2, 9 and 10, comprises a main body 82 having a pair of opposed legs 83 and 84 spaced apart to embrace the knob. Legs 83 and 84 are provided with inturned end portions that insert down into the opposed vertical slots 73 and 74 and are turned into the arcuate undercut grooves 75 and 76 so that the main body 82 is held tightly to the top of the outer shell 18. A pair of opposed hand-gripped fingers 85 and 86 are shown extending out opposite sides of the bodh above legs 83 and 84, respectively.

A plunger 87 extends down through a vertical hole in the body and beyond the legs and has a cap 88 at the top end and a curved recess 98 at the bottom end that engages a rounded top of hub portion 31. A return spring 90 is provided between the body and the cap 88 to return the plunger after a depression.

In the operating position as shown in FIG. 2, the legs 83 and 84 hold the body 82 in place on the head section. Depression of the plunger as with the thumb forces the male hub 31 out of the female socket 32 to separate the two container shells.

It is contemplated that the above described dispenser could be returned to the druggist for refilling and the druggist would be the only one in possession of the removal tool 81.

Although the present invention has been described with a certain degree of particularity, it is understood that the present disclosure has been made by way of example and that changes in details of structure may be made without departing from the spirit thereof.

What is claimed is:

1. A child-proof dispenser for a strip of drugs and the like comprising:

a container having an inner compartment for enclosing a coiled strip of drugs, said container including separate, interfitting, inner and outer shells, said inner and outer shells having releasably interlocking central hub portions holding said shells together and supporting said outer shell to rotate relative to said inner shell, said inner shell having an inner dispensing opening and said outer shell having an outer dispensing opening, said inner shell having an inside guide section forming a guide passage leading to said inner dispensing opening and a cut-off blade defining one side of said inner dispensing opening;

biasing means between said shells to move said outer shell to an at-rest position with respect to said inner shell to cover said inner dispensing opening with said outer shell to prevent dispensing via said inner dispensing opening until said inner shell is held against movement and a turning force is applied to said outer shell to aline said inner and outer dispensing openings; and ejecting means arranged to move relative to said shells to bear against a portion of said strip in said guide passage to advance said strip through said alined inner and outer dispensing openings and remove the dosage from the strip by cutting the strip on said cut-off blade.

2. A child-proof dispenser as set forth in claim 1 wherein said inner shell has a bottom wall portion and an inner sidewall portion and said outer shell has a top wall portion extending over the top of said inner sidewall portion and an outer sidewall portion overlapping said inner sidewall portion.

3. A child-proof dispenser as set forth in claim 2 wherein the central hub portion on said outer shell has a center hole and an annular inwardly extending ridge and the central hub portion on said inner shell inserts into said center hole and has an annular recess that receives said ridge to form a releasable locking joint for said shells.

4. A child-proof dispenser as set forth in claim 3 wherein the central hub portion on said inner shell has a rounded head above said annular recess.

5. A child-proof dispenser as set forth in claim 1 wherein said ejecting means includes a trigger having a pair of opposed rear support pins disposed for guided movement in a slot in said outer shell and extending through a slot in said inner shell and into said guide passage to engage said strip, said trigger further having a pair of opposed front pins in a slot in said outer shell to prevent the forward end of said trigger from flipping out of the slot in said outer shell through which said trigger extends.

6. A child-proof dispenser as set forth in claim 1 including spaced, radially extending ribs on the top of said outer shell and on the bottom of said inner shell to facilitate the gripping thereof by hand for the rotation of the outer shell relative to said inner shell.

7. A child-proof dispenser as set forth in claim 1 including a knob on the top of said outer shell having a central hole alined with the center hole of said hub portion on said inner shell, said knob having means for supporting a removal tool, said removal tool including a plunger that extends into said lined holes to engage said hub portion in said inner shell to release said inner and outer shells from one another upon movement of said plunger against said hub portion.

8. A child-proof dispenser as set forth in claim 7 wherein said knob has a pair of opposed vertical notches that communicate with a pair of arcuate notches in a lower portion thereof at the top of said top wall portion to receive and hold inturned end portions of the removal tool.

9. A child-proof dispenser as set forth in claim 8 including spaced grip ribs on said knob to assist in rotating said outer shell.

10. A child-proof dispenser as set forth in claim 1 including radial surfaces carried by said inner shell and said outer shell to prevent relative rotation therebetween in one direction in the at-rest position.

11. A child-proof dispenser as set forth in claim 1 wherein said biasing means is in the form of a compression spring held between opposite radial surfaces on an outer surface of said inner shell and an inner surface of said outer shell, said compression spring being spread in the at-rest position and compressed in the dispensing position for said shells.

12. A child-proof dispenser as set forth in claim 1 including a coil spring mounted on said central hub portion to urge said coiled strip toward said dispensing openings.

13. A child-proof dispenser for a coiled strip of blister-packaged drugs and the like comprising:

a container having an inner compartment sized and shaped for enclosing a coiled strip of blister-packaged drugs, said container including separate, interfitting, cup-shaped inner and outer shells, said inner shell having a bottom wall portion and an inner sidewall portion and said outer shell fitted over said inner shell, said outer shell including a top wall portion extending over the top of said inner shell and an outer sidewall portion overlapping said inner sidewall portion substantially the full vertical extent thereof, leaving only the bottom wall portion exposed, said inner and outer shells having central hub portions holding said shells together by means of a snap-fit male and female locking joint and supporting said outer shell to rotate relative to said inner shell, said inner shell having an inner dispensing opening and said outer shell having an outer dispensing opening, said inner shell having an inside guide section forming a guide passage leading to said inner dispensing opening and a cut-off blade defining one side of said inner dispensing opening;

a knob on the top of said outer shell having a central hole alined with the center hole of said hub portion on said inner shell and having means for supporting a removal tool, said removal tool including a plunger that extends into said alined holes to engage said hub portion in said inner shell to release said inner and outer shells from one another;

resilient means between said shells to move said outer shell to an at-rest position with respect to said inner shell to cover said inner dispensing opening with said outer shell to prevent dispensing via said inner dispensing opening until said inner shell is held against movement and a turning force is applied to said outer shell to aline said inner and outer dispensing openings; and an ejecting trigger arranged to move relative to said shells having a downturned front portion arranged to bear against a portion of said strip in said guide passage to advance said strip through said alined inner and outer dispensing openings and remove a dosage from the strip by cutting the strip on said cut-off blade.

14. A child-proof dispenser as set forth in claim 13 wherein said resilient means is a coiled spring.

* * * * *